US005696661A

United States Patent [19]

Vieira et al.

[11] Patent Number: 5,696,661

[45] Date of Patent: Dec. 9, 1997

[54] REMANENCE SWITCHING DEVICE

[76] Inventors: Marisa Barbosa Vieira, Avenida Ipiranga, 112; Maria Carolina Tirico Felizatti, Rua Comendador Pedro Morganti, 2230, both of 14800-000 Araraquara, Sao Paulo, Brazil

[21] Appl. No.: 719,394

[22] Filed: Sep. 24, 1996

[51] Int. Cl.[6] ..... H01H 47/18

[52] U.S. Cl. ..... 361/200; 361/152; 361/156

[58] Field of Search ..... 361/152, 153, 361/154, 155, 156, 189–190, 195, 199–200, 205

[56] References Cited

U.S. PATENT DOCUMENTS 3,564,346 2/1971 Atkins ..... 361/200

3,987,346 10/1976 Riordan ..... 361/200

*Primary Examiner*—Brian K. Young

*Assistant Examiner*—Michael J. Sherry

*Attorney, Agent, or Firm*—Ostrolenk, Faber, Gerb & Soffen, LLP

[57] ABSTRACT

The present invention is directed to a device intended to turn on loads and keep them on for a pre-established period of time and includes a remanence relay which includes a coil L, a movable contact 1, a fixed, normally opened contact **2*b* and a fixed, normally closed contact 2*a*. When a remote push switch S is pushed to its ON position, a first current flows through the coil L in a first direction to cause the movable contact 1 to move from engagement with the contact 2*b* to engagement with the contact 2*a*. As a result, power is applied to a load 5. When the switch S is opened, a timing circuit, which includes a capacitor C1, a resistor R3, an electric disruptive device D5 and a diode D4, is initiated which charges the capacitor C1. When the voltage of the capacitor C1 reaches the threshold voltage of the disruptive device D5, a second current opposite in direction to the first current flows through the coil L to cause the movable contact to move to the contact 2*b* and disconnect the load 5. When the push switch S is in the ON position, a third circuit, which includes the capacitor C1, the diode D3 and a second capacitor shunt connected with a resistor R1, discharges the capacitor C1 to a predetermined low voltage, the predetermined low voltage of the capacitor C1 being determined by a shunt connected diode D1**.

29 Claims, 1 Drawing Sheet

REMANENCE SWITCHING DEVICE

BACKGROUND OF THE INVENTION

The present invention relates to a device intended to turn on loads and keep them on for a pre-established period of time.

It basically consists of a remanence relay which—besides exerting an important logical function—is also a power unit, associated with a multi-functional electric-electronic circuit which functions as a time counter, a resetter and a controller to turn the load on/off.

This device may work as a remote time control unit, whose wiring utilized to activate it from a distance may be composed of thin, i.e., small gauge, wires as compared to the wiring of the load circuit where the device is installed.

When compared to other similar devices, it differs firstly due to its power unit being a remanence relay, whereas existing similar devices employ either power semiconductors or conventional relays.

Another important distinguishing characteristic resides in the fact that part of the time counter circuit is also the storing element of the energy utilized to turn off the load.

With respect to operational features, it presents the same ones as those of similar devices, among which are the possibility of plural control by means of thin conductors, and resetting, which enables the start of the counting of the operation time at any moment after it has been initiated.

Another important characteristic lies in the fact that the device may be locked (remotely) at the turned-on position, through the same thin conductors utilized to turn it on. Although this characteristic may also be found in some similar devices, the possibility of locking these devices at the turned-on position is only available in the latter as a local resource (in the device itself) and not by means of remote activation.

SUMMARY OF THE INVENTION

It is an object of the present invention to provide an improved device for switching power to a load and, more particularly, to provide such a device which includes a remanence relay.

These and other objects of the invention are achieved by a device for switching power to a load, which comprises a remanence relay having a coil, a normally opened contact, a normally closed contact and a movable contact connectable to a source of power and movable between the normally opened and the normally closed contacts, the movable contact moving from engagement with the normally opened contact to engagement with the normally closed contact when current of a predetermined magnitude is passed through the coil in a first direction and moving from engagement with the normally closed contact to engagement with the normally opened contact when current of a prescribed magnitude is passed through the coil in an opposite direction. The device further includes a first circuit connectable to an ON/OFF switch such that when the switch is in the ON position, current is passed through the coil in the first direction to cause the moving contact to move from engagement with the normally opened contact to engagement with the normally closed contact, the normally closed contact being connected to the load to connect the load to a source of electric power through the movable contact. The device further includes a second circuit including a first electric current storing element connected to the coil through an electric disruptive device for charging the first electric current storing element to a predetermined high voltage equal to the threshold voltage of the electric disruptive device when the ON/OFF switch is in its OFF position to pass a current of the prescribed magnitude through the coil in the opposite direction to cause the movable contact of the remanence relay to move from engagement with the normally closed contact to engagement with the normally opened contact. The device further includes a third circuit including a second electric current storing element connected to the ON/OFF switch and to the first electric current storing element for discharging the first electric current storing element to a predetermined low voltage when the ON/OFF switch is in its ON position.

Other features and advantages of the present invention will become apparent from the following description of the invention which refers to the accompanying drawings.

BRIEF DESCRIPTION OF THE DRAWING(S)

FIG. 1, is a schematic of a device according to the present invention, the arrows indicating the direction of the electric current in the several different operational states of the device.

DETAILED DESCRIPTION OF EMBODIMENTS OF THE INVENTION

Figure 1:
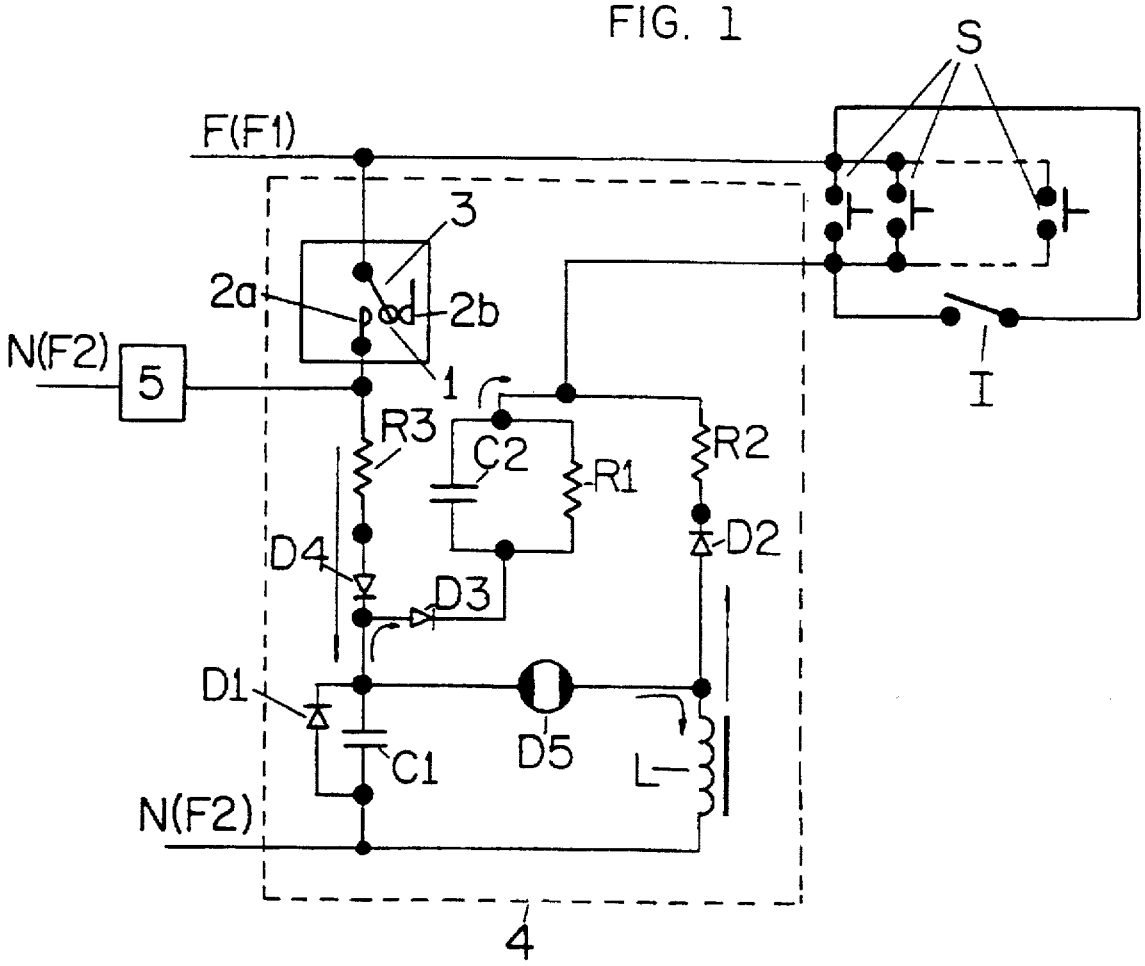

Referring now to FIG. 1, there is shown a device 4 embodying certain principles of the invention. The device 4 includes a remanence relay comprised of a coil L and contacts 1, **2*a* and 2*b*. The device 4** further includes first, second and third dissipative electric current limiting elements $R_1$, $R_2$ and $R_3$, respectively, which advantageously are either fixed value or variable value resistors made of carbon or metal film; first, second, third and fourth electric current directing devices $D_1$, $D_2$, $D_3$, and $D_4$, respectively, which may advantageously be current rectifying devices and, preferably, are semiconductor diodes; first and second electric charge storing elements $C_1$ and $C_2$, respectively, which advantageously are capacitors and, preferably, are polarized electrolytic capacitors; and an electric disruptive element, $D_5$, such as gap or neon bulb or preferably a diac or several diacs in series.

The device 4 is shown in the turned-off state in which the remanence relay is magnetized, so that its magnetic circuit remains permanently closed due to the magnetic force of attraction generated by the remanent flux present in its core, with the moving contact 1 touching the fixed contact **2*b*, termed "normally opened" (NO) and with a load 5 controlled by the device 4** being off.

In the turning-on operation of the device 4, the activation of any of a plurality of push switches S, external to the device, causes the circulation of an electric current—directed to the phase conductor F or the first phase conductor F1 of an electric network from the neutral conductor N, or second phase conductor F2 of the same monophasic electric network (of the type phase-neutral or phase-phase)—through the second dissipative electric current limiting element R2 connected in series with the second electric current directing element D2 and the electric coil L of the remanence relay. The passage of this electric current through the electric coil L of the remanence relay in this direction will generate a magnetic flux in the core of the remanence relay, always with the same polarity and with sufficient amplitude to demagnetize the core, which is contrary to that existing in the core of the remanence relay when magnetized and with its magnetic structure closed and causes the moving conductive plate 3 of the remanence relay to move—due to spring action applied to it—towards closing the moving contact 1 and the fixed contact 2a, termed "normally closed" (NC).

The fixed contact 2a, upon being closed, turns on the load 5, because this load is submitted to the difference of potential either between the phase F and the neutral N conductors or between the first F1 and the second F2 phase conductors of the electric network. Additionally, the fixed contact 2a provides a path for the electric current, through the third dissipative electric limiting current element R3 connected in series with the fourth electric current directing element D4, towards the first electric charge storing element C1.

Simultaneously, there will also be the passage of energy in the form of an electric current pulse, which will flow through a serial electric circuit consisting of a shunt mesh composed of the second electric charge storing element C2 and the first dissipative electric current limiting element R1, the third electric current directing element D3 and another shunt mesh consisting of the first electric charge storing element C1 and the first electric current directing element D1. This electric current pulse flows from the neutral conductor N, or second phase conductor F2, to the phase conductor F, or first phase conductor F1, of the electric network.

The energy pulse mentioned above refers to the energy transference that occurs from the first electric charge storing element C1 to the second electric charge storing element C2, so that the first electric charge storing element C1 remains with a residual electric charge equivalent in voltage to the voltage drop on the first electric current directing element D1 shunt-connected with it, whereupon this residual electric charge will act as the initial reference to a time counter to be described.

If for any reason the first electric charge storing element C1 is found discharged, there will be no energy transference from it to the second electric charge storing element C2, since the first electric charge storing element C1 will now be in an initial reference state. The quantification of this initial state of electric charges in the electric charge storing element C1 depends on the amount of energy that the second electric charge storing element C2 is capable of storing, as well as on the voltage drop on the first electric current directing element D1, shunt-connected with the first electric charge storing element C1.

As long as any of the push switches S are closed, the electric current, which has been described in connection with the turning-on operation of the device 4, will keep on flowing through the electric coil L of the remanence relay, without causing any alteration in the state of the remanence relay. Additionally, the initial state of electric charges in the first electric charge storing element C1 is maintained by the electric current that flows from the neutral conductor N, or second phase conductor F2, to the phase conductor F, or first phase conductor F1, which is limited by the first dissipative electric current limiting element R1—shunt-connected with the second electric charge storing element C2—and directed by the first and the third electric current directing elements series-connected and with the same polarization direction D1 and D3.

As soon as the push switch S that has been activated is opened, the second electric charge storing element C2 begins to discharge through the first dissipative electric current limiting element R1 shunt-connected with it until its voltage equals zero.

Meanwhile, the electric current that flows from the NC contact 2a of the remanence relay to the neutral conductor N, or second phase conductor F2 through the first electric charging storing element C1, will bring about a shift in the charge condition and in the associated voltage in this element from the reference level previously described, thus activating the time counter.

When a voltage threshold imposed by the electric disruptive element D5 is reached, the energy stored in the first electric charge storing element C1 is discharged in the form of an electric current pulse through the electric coil L of the remanence relay towards the neutral conductor N, or second phase conductor F2.

This electric current in the electric coil L of the remanence relay creates a magnetic flux in the core of the remanence relay, of a polarity opposite to that of the flux produced by the closing of the moving contact 1 and NC fixed contact 2a, and with sufficient amplitude to reach the magnetic saturation of the core.

Thus, the magnetic structure associated with the moving conductive plate 3 of the remanence relay moves, closing the magnetic circuit, which is kept closed even after the extinction of the electric current pulse in the electric coil L. It is kept closed due to the resulting action of two forces: the prevalent attracting magnetic force generated by the high remanent magnetic field and the opposing spring action applied by the moving conductive plate 3.

The closing movement of the magnetic circuit of the remanence relay causes the opening of the moving contact 1 and NC fixed contact 2a, thus stopping the process of storing electric charges in the first electric charge storing element C1, at the same time as the connected load 5 is opened, causing the remanence relay to keep closed the moving contact 1 and the normally open NO fixed contact 2a, causing the device 4 to return to the turned-off state.

From the foregoing, it should be appreciated that the first electric charge storing element C1, the third electric current limiting element R3, the electric disruptive element D5 and the fourth electric current directing element D4 constitute the time counter, since the turned-on time of the device 4 may be modified by altering the values of the first three elements, individually or together.

It should also be noted that if at any time, during the counting of time of the device 4, any one of the push switches S is activated, this will force the establishment of the initial reference level in the first electric charge storing element C1, which will zero or reset the time counter though not provoking the commutation of the remanence relay.

It should be also noted that—since the counting of time begins only when the activating pressure on the push switch S is removed—if a rocker switch I is shunt-installed with the push switch S, while the former is closed, the reference level in the first electric charge storing element C1 is maintained and the device 4 remains turned-on, i.e., the device remains electrically "locked" at the position in which the connected load 5 stays energized.

As far as the assemblage of the device 4 is concerned, it may also be divided into two parts: one related to the power, consisting of the remanence relay, whose electric coil L and commutation elements 1, 2a, 2band 3 are represented in FIG. 1; and another part which executes the control of the turning-on/off currents, timing, resetting and locking operations as represented in FIG. 1 by the elements R1, R2, R3, D1, D2, D3, D4, D5, C1 and C2; both linked by small gauge conductors.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for switching power to a load, which comprises:

a remanence relay having a coil, a normally opened contact, a normally closed contact and a movable contact connectable to a source of power and movable between engagement with the normally opened and engagement with the normally closed contacts, the movable contact moving from engagement with the normally opened contact to engagement with the normally closed contact when current of a predetermined magnitude is passed through the coil in a first direction and moving from engagement with the normally closed contact to engagement with the normally opened contact when current of a prescribed magnitude is passed through the coil in an opposite direction;

a first circuit connectable to an ON/OFF switch such that when the ON/OFF switch is in the ON position current is passed through the coil in the first direction to cause the moving contact to move from engagement with the normally opened contact to engagement with the normally closed contact, the normally closed contact being connectable to the load to connect the load to a source of electric power through the movable contact;

a second circuit including a first electric current storing element connected to the coil through an electric disruptive device, the second circuit being operative when the ON/OFF switch is in its OFF position to charge the electric current storing element to a predetermined high voltage equal to the threshold voltage of the electric disruptive device to pass a current of the prescribed magnitude through the coil in the opposite direction to cause the movable contact of the remanence relay to move from engagement with the normally closed contact to engagement with the normally opened contact; and a third circuit including a second electric current storing element connectable to the ON/OFF switch and to the first electric current storing element for discharging the first electric current storing element to a predetermined low voltage when the ON/OFF switch is in its ON position.

2. A device according to claim 1, wherein the first and second electric charge storing elements are capacitors.

3. A device according to claim 2, wherein the electric capacitors are polarized electrolytic capacitors.

4. A device according to claim 1, wherein a first dissipative electric current limiting element is shunt connected with the second electric charge storing element.

5. A device according to claim 4, wherein the dissipative electric current limiting element is a resistor and wherein the second electric charge storing element is a capacitor.

6. A device according to claim 1, including a first electric current directing element shunt connected with the first electric current storing element to establish the magnitude of the predetermined low voltage.

7. A device according to claim 6, wherein the first electric current directing element is a diode and the first electric current storing element is a capacitor.

8. A device according to claim 1, wherein the first circuit includes the coil of the remanence relay, a second electric current directing element and a second dissipative electric current limiting element.

9. A device according to claim 8, wherein a second electric current directing element is a diode and a second dissipative electric current limiting element is a resistor.

10. A device according to claim 1, wherein the third circuit includes the first electric charge storing element shunt connected with the first electric current directing element, a third electric current directing element and a second electric storing element shunt connected with a first dissipative electric current limiting element.

11. A device according to claim 10, wherein the first and second electric charge storing elements are capacitors, the first and third electric current directing elements are diodes and the first dissipative electric current limiting element is a resistor.

12. A device according to claim 1, wherein the second circuit includes a fourth electric current directing element and a third dissipative electric current limiting element.

13. A device according to claim 12, wherein the fourth electric current directing element is a diode and the third dissipative electric current limiting element is a resistor.

14. A device according to claim 1, wherein the first and third circuits are connected in parallel in the turning-on operation of the device.

15. A device according to claim 12, wherein the second circuit is a timing circuit for setting the time during which the movable contact of the remanence relay is engaged with the normally closed contact to connect the load to the source of power, the time being determined by the values of the third dissipative electric current limiting element, the threshold value of the electric disruptive element and the value of the first electric charge element.

16. A device according to claim 15, wherein the electric disruptive element is a gap bulb.

17. A device according to claim 15, wherein the electric disruptive element is a neon bulb.

18. A device according to claim 15, wherein the electric disruptive element is a diac.

19. A switching apparatus for selectively connecting and disconnecting a load to and from a source of electric power, which comprises:

an ON/OFF switch having first and second contacts the first and second contacts being normally opened in the OFF position of the ON/OFF switch and being connected to each other when the ON/OFF switch is in its ON position;

a remanence relay having a coil, a normally opened contact and a normally closed contact and a movable contact movable between the normally opened and normally closed contacts, the movable contact moving from engagement with the normally opened contact to engagement with the normally closed contact when current of a predetermined magnitude is passed through the coil in a first direction and moving from engagement with the normally closed contact to engagement with the normally opened contact when current of a prescribed magnitude is passed through the coil in an opposite direction;

means for connecting the movable contact to a first terminal of a source of power;

means for connecting the normally closed contact of the remanence relay to the load, the load also being connected to a second terminal of the source of power;

a first series circuit including the coil of the remanence relay, a second dissipative electric current limiting device, a second electric current directing element and the first and second contacts of the ON/OFF switch for passing current of the predetermined magnitude through the coil in the first direction when the ON/OFF switch is in its ON position;

a second series circuit including the normally closed contact of the remanence relay, a third dissipative electric current limiting device and a fourth electric current directing element for charging a first electric charge storing element to a predetermined voltage;

a third series circuit including the first electric charge storing element, an electric disruptive device and the coil of the remanence relay for when the ON/OFF switch is in its OFF position, passing current through the coil of the remanence relay of the prescribed magnitude in an opposite direction when the voltage of the capacitor is at least equal to a threshold voltage of the electric disruptive device; and a fourth series circuit including a third electric current directing element, a shunt connection of a second electric charge storing element and a first dissipative electric current limiting device and the first and second contacts of the ON/OFF switch for discharging the first electric charge storing element to a predetermined low voltage when the ON/OFF switch is in its ON position the predetermined low voltage being established by a first electric current directing element shunt connected with the first electric charge storing element.

20. A device according to claim 19, wherein the first, second and third dissipative electric current limiting elements are resistors.

21. A device according to claim 19, wherein the first, second, third and fourth electric current directing elements are current rectifying elements.

22. A device according to claim 21, wherein the current rectifying elements are semiconductor diodes.

23. A device according to claim 19, wherein the third dissipative electric current limiting element is comprised of a plurality of a series or shunt connected, fixed or variable resistors.

24. A device according to claim 19, wherein each of the first and second electric charge storing elements are comprised of a plurality of series or shunt connected polarized electrolytic capacitors.

25. A device according to claim 19, wherein the electric disruptive element is a gap bulb.

26. A device according to claim 19, wherein the electric disruptive element is a neon bulb.

27. A device according to claim 19, wherein the electric disruptive element is a diac.

28. A device according to claim 19, wherein the electric disruptive element includes several diacs series connected.

29. A device according to claim 19, which is physically divided into first and second units, the first unit including the remanence relay and the second unit including the first, second and third dissipative electric current limiting elements, the first, second, third and fourth electric current directing elements, the first and second electric charge storing elements and the electric disruptive element, the first and second units being interconnected by small gauge electric wires.

* * * * *